United States Patent [19]

Volpe

[11] 3,952,778

[45] Apr. 27, 1976

[54] SELVAGE FORMING DEVICE

[75] Inventor: Richard L. Volpe, Hopedale, Mass.

[73] Assignee: Rockwell International Corporation, Pittsburgh, Pa.

[22] Filed: Apr. 28, 1975

[21] Appl. No.: 572,212

[52] U.S. Cl. ..... 139/54
[51] Int. Cl.[2] ..... D03D 7/00
[58] Field of Search ..... 139/54, 122 S

[56] References Cited

UNITED STATES PATENTS

| | | | |
|---|---|---|---|
| 1,226,361 | 5/1917 | Niederwerfer | 139/54 |
| 3,227,191 | 1/1966 | Juillard | 139/54 |
| 3,871,414 | 3/1975 | Palencher | 139/54 |

*Primary Examiner*—Henry S. Jaudon

[57] ABSTRACT

An apparatus for forming a leno selvage along the edge of fabric being woven on a loom having a pair of rod members carried in and for movement with adjacent harnesses. A pair of support blocks are mounted in spaced relation and for sliding movement on the rod members with one having a selvage thread guide fixed thereto and the other having a selvage thread guide mounted for pivotal movement. Movement of the harnesses effects sliding movement of the support blocks with the selvage thread guides carried thereby forming shed openings for receiving weft yarn. The combination of a fixed and pivotable selvage thread guide alternately cross lays their selvage threads so as to lock each pick of weft between the crossed selvage threads.

1 Claim, 10 Drawing Figures

SELVAGE FORMING DEVICE

BACKGROUND OF THE INVENTION

1. Field of the Invention

The invention pertains to shuttleless looms of the type which insert each pick of weft by two reciprocating elements that are commonly referred to as the inserting and extending carriers. For a detailed description of one form of such loom, attention is hereby directed to U.S. Pat. No. 2,604,123. The insertion of weft, drawn from an outside source, into sheds of warp threads by means of opposed carrier members does not result in forming selvage at either or both sides of the fabric and more particularly, the invention pertains to an improved device for use in such looms which will form a so-called twisted or leno type selvage along the edge of fabric as it is formed.

2. Description of the Prior Art

In looms wherein weft is not interwoven with warp threads as in fly shuttle looms to form normal selvages at both sides of the fabric, it is common practice to form a twisted or leno selvage by such a device as disclosed in the teachings of U.S. Pat. No. 2,710,631. This form of device produces a twisted or leno selvage by feeding and shedding two selvage threads by a rotatable disc member which twists them and the pick of weft together at each or spaced shed changes. The selvage threads are drawn from supply spools that are carried on the rotatable disc which requires a separate means of drive such as belts, chains or gearing operatively interconnecting said disc with any suitable source of rotary motion on the loom.

The type of selvage mechanism disclosed in U.S. Pat. No. 2,710,631 has performed its intended function satisfactorily on looms forming weaves which require from two to 10 harnesses.

With an increase in the number of harnesses in a loom for the purpose of forming more complex weaves, such as by dobby weaving necessitates a greater number of harnesses and can increease the number to as high as 24 harnesesses per loom.

An increase in the number of harnesses per loom necessitates substantially more space to accommodate said harnesses and requires, what is considered, undesirable changes to the disc type selvage mechanism in order to utilize the same.

The additional space required by an increase in the number of harnesses requires that the rotatable disc on which the selvage thread spools are carried be mounted further rearwardly on the loom. To do this the disc must be increased in diameter so that the selvage thread spools can be mounted further apart in order to form the desired angular opening of the selvage threads and conform generally to the shed opening formed by the warp threads so as to receive the end of a pick therebetween. Additionally the rotatable disc is provided with draw springs or so-called spring take-up arms which are operatively associated with each spool of selvage thread carried on said disc and serve to prevent slack in the selvage thread when their respective spools come into horizontal alignment while being rotated with said disc. These spring take-up arms are caused to move to a position which takes up the slack of their respective selvage thread and when relocated rearwardly to accommodate more harnesses would also have to be made larger like that of the disc. Each spring take-up arm is operatively associated with a single selvage thread and the combination of being made larger and the relative distance it must move to the position to perform its function coupled with the fact that it must assume said position more quickly by comparison would in many instances be detrimental to the selvage thread. Additionally the added space required by an enlarged disc and moving the same further rearwardly would be objected to as being too closely situated to certain elements of a loom such as the automatic pick finder as well as the many driving connections between the dobby and the harnesses that would make the assessibility to these and other devices on the loom difficult.

The selvage forming device comprising the invention would create none of the problems described above and can satisfactorily perform its intended function in looms operating with either the minimum or maximum number of harnesses therein.

SUMMARY OF THE INVENTION

The selvage forming device for shuttleless looms of the present invention includes a pair of generally vertically disposed rod members which are situated in parallel relation and include end members for attachment to and movement with adjacent harness frames. First and second support blocks are mounted in spaced relation and for sliding movement on the rod members and include a biasing means for continuosly urging said support blocks away from each other. The upper or first support block has a selvage thread guide fixed thereon in a preselected position and the lower or second support block has a selvage thread guide mounted for pivotal movement thereon.

The selvage thread guide pivotably carried on the lower support block is in the form of a double armed lever and extends in a generally vertical direction. The upper arm of this lever includes a laterally extending finger having a pair of spaced eyelets through which selvage threads extend. The lower arm of this lever is provided with a roller member which by a baising means is held in contact with the outer surface of the first or forward rod member. The forward rod member is provided with a recess which defines a camming surface which as the support blocks are caused to slide on the rod members by the shedding motion of the harnesses, the roller member carried by the lower arm of the double armed lever is caused to move into and out of said recess. This camming action causes the double armed lever to pivot first in one direction and then the other to effect movement of the laterally extending finger with its selvage thread eyelets between innermost and outermost positions. In timed relation with the shedding of the warp yarns and the selvage threads, the movement of the laterally extending finger positions its selvage threads first on one side and then the other of the selvage threads carried by the selvage thread guide fixed on the first support block. The combination of the lower selvage threads moving as described relative to upper selvage threads forms a combination of loops which grip and hold each inserted pick of weft. The upper selvage threads cooperate with the lower ones in a manner whereby the loops of the latter engage the top of the weft yarn and the upper selvage threads engage the bottom of said weft yarn.

It is a general object of the invention to provide a compact and effective unitary mechanism for easy application to a loom without resorting to an independent drive therefor which will carry and feed a predetermined number of selvage threads and to shed the latter as required to form a desired leno type selvage.

A further object of the invention is to provide an improved mechanism for shuttleless looms that is driven by a pair of adjacent harnesses and without limitation to the number of harnesses which may be used in such a loom, and that will form a desirable leno type selvage along the edge of the fabric as it is formed.

These and other objects of the present invention will become more fully apparent by reference to the appended claims and as the following detailed description proceeds in reference to the figures of drawing wherein:

DESCRIPTION OF THE PREFERRED EMBODIMENT

As the general construction and operation of a shuttleless loom to which the present invention is applicable is well known and familiar to those conversant in the art, and as the invention is entirely concerned with an improved selvage forming device for such looms, it is only considered necessary here to illustrate and describe those parts which are directly concerned with a preferred form of the present invention.

Figure 1:
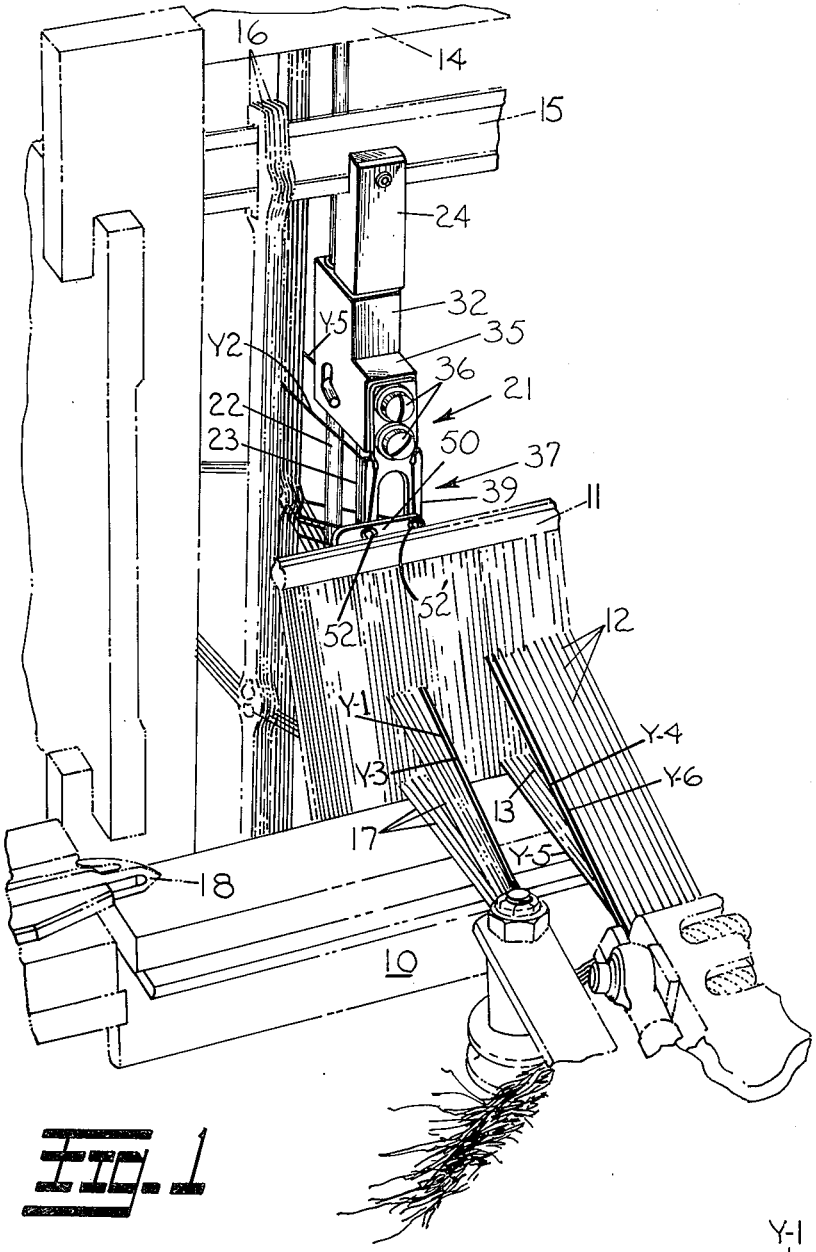
FIG. 1 is a perspective view of a portion of a shuttleless loom showing the device according to the invention applied thereto.
Figure 7:
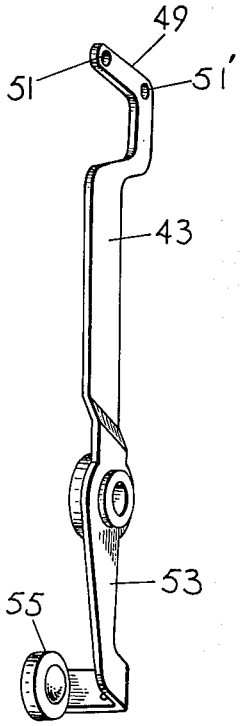
FIG. 7 is a perspective view of one of the lower selvage thread guides in FIGS. 5 and 6 showing the roller member for effecting its camming movement.

In FIG. 1 a portion of the forward upper left hand end of a shuttleless loom is shown and among the various parts thereof there is shown a lay beam 10 having a reed 11 supported thereon through which warp threads 12 extend to form shed openings 13 in a well known manner.

A conventional harness mechanism is utilized and in FIG. 1 a portion of the first harness frame in back of the reed is identified by numeral 14 and includes heddle bars 15 (one only shown) for supporting the usual multiplicity of heddles 16 through which both warp threads 12 and waste selvage threads 17 extend.

Figure 2:
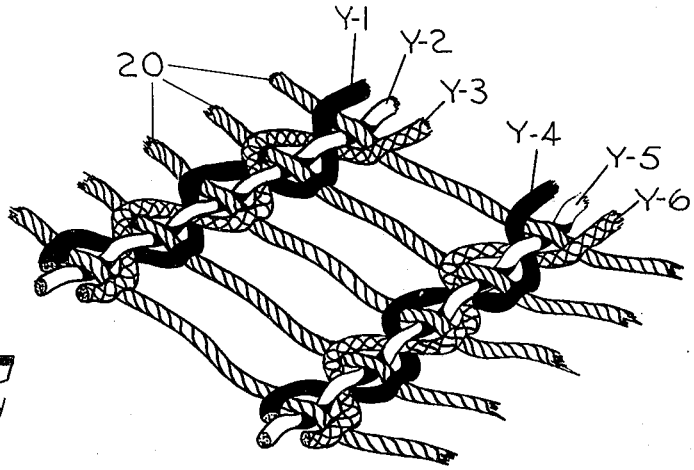
FIG. 2 is a perspective view showing a leno type selvage as provided by the present invention.
Figure 9:
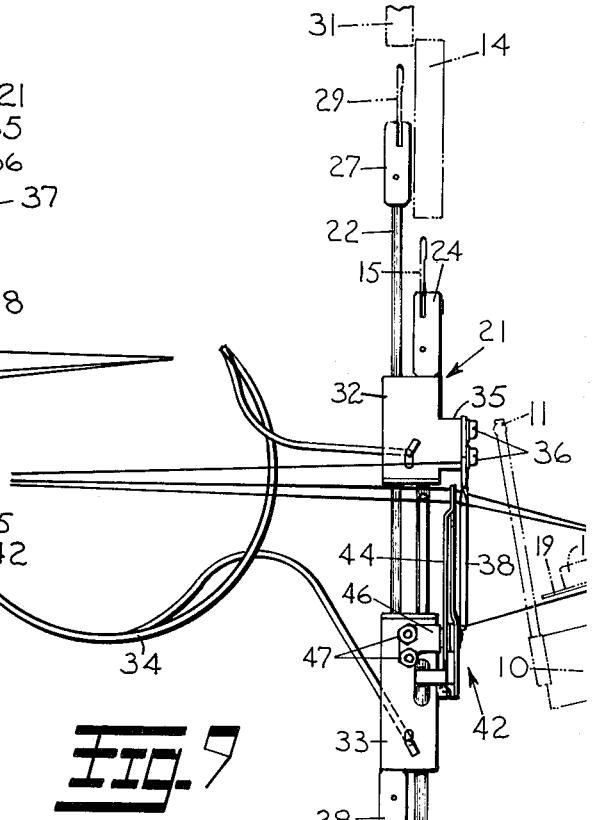
FIG. 9 is a view similar to FIG. 8 after crossing and forming a selvage shed opening which positions the lower selvage thread guides in that position shown in FIG. 6.
Figure 10:
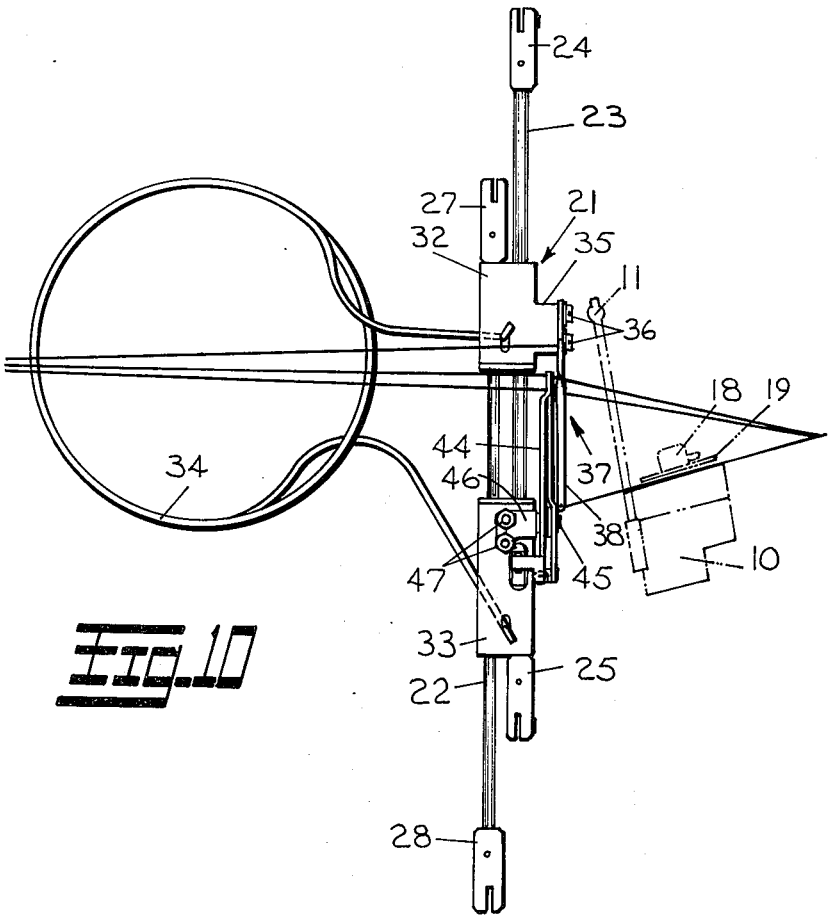
FIG. 10 is a view similar to FIG. 9 showing the alternate crossing which positions the lower selvage thread guides in that position shown in FIG. 5.

A portion of the weft extending carrier is identified in FIGS. 1, 9 and 10 by numeral 18 and is fixed to the end of a flexible tape 19 which by means not shown is caused to be wrapped about and unwrapped from an oscillating tape wheel carried on the side of the loom. As is well known to those familiar with the art, the extending carrier 18 is caused to enter a shed and at a point approximately mid-way of latter has transferred to it the weft yarn introduced on the opposite side of the shed by the so-called inserting carrier. After receiving the introduced weft yarn the carriers reverse their direction of travel and the extending carrier draws the weft through the remainder of the shed to complete a single pick. In FIG. 2 the weft yarn is identified by numeral 20 and is shown interlocked with two separate groups of leno selvage threads which are twisted by the device comprising the invention and which will be fully described hereinafter. One group of these leno selvage threads is identified in FIG. 2 by Y-1, Y-2 and Y-3 and the other group by Y-4, Y-5 and Y-6.

As shown in FIG. 1 the leno selvage threads Y-4, Y-5 and Y-6 are located immediately adjacent to the warp threads 12 and the Y-1, Y-2 and Y-3 threads adjacent to the waste selvage threads 17.

The selvage forming device comprising the invention is identified generally in the various figures of drawing by numeral 21 and includes first and second elongated carrier members in the form of rod members 22 and 23 respectively. These rod members extend generally vertically and in parallel relation and each is provided with bifurcated end members fixed thereon which serve to attach them to adjacent harness frames. The end members for rod member 23 are depicted by numerals 24 and 25 and as shown in FIGS. 1 and 9 attach to the heddle bars 15 and 26 of the forward harness frame 31 located rearwardly of and immediately adjacent to harness frame 14.

Figure 8:
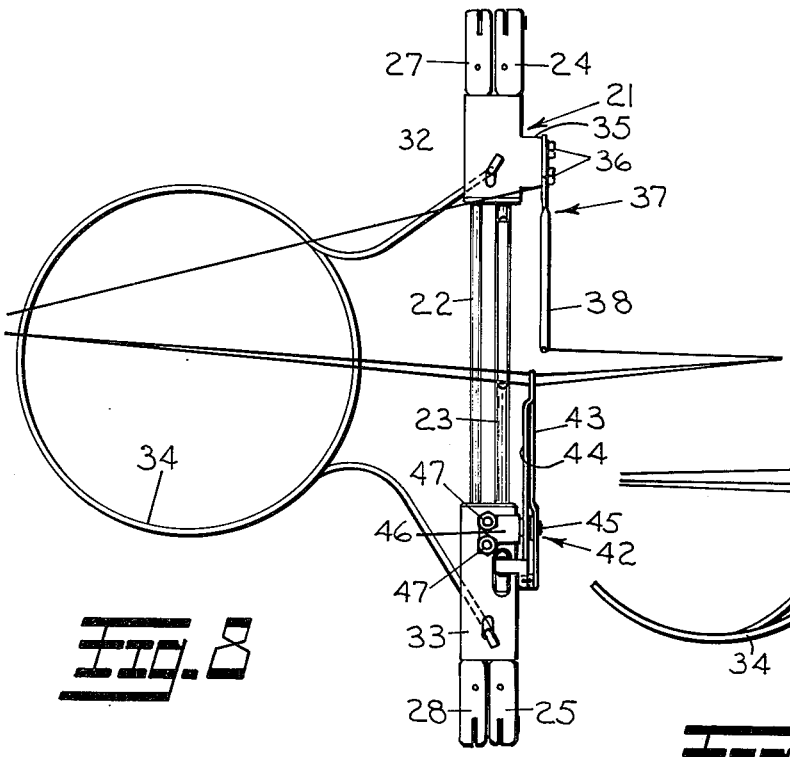
FIG. 8 is a view in side elevation of the device in FIG. 3 showing the biasing means for urging the support blocks away from each other, and the selvage thread guides with their selvage threads at crossing position.

First and second support blocks 32 and 33 respectively are mounted for sliding movement on the rod members 22 and 23. These support bocks 32 and 33 are disposed in spaced relation on rod members 22 and 23 and are interconnected by the ends of a loop type torsion spring 34 (FIGS. 8, 9 and 10) which continuously urges said support blocks away from each other.

The upper or first support block 32 is provided with an integrally formed and forwardly extending lug 35 and has fixed thereto by means of screws 36 a first selvage thread guide means generally indicated by number 37. This first selvage thread guide means 37 includes a pair of spaced and depending bar members 38 and 39 which include recesses 40 at their upper ends and eyelets 41 adjacent their lower ends through which the leno selvage threads Y-2 and Y-5 extend.

Figure 3:
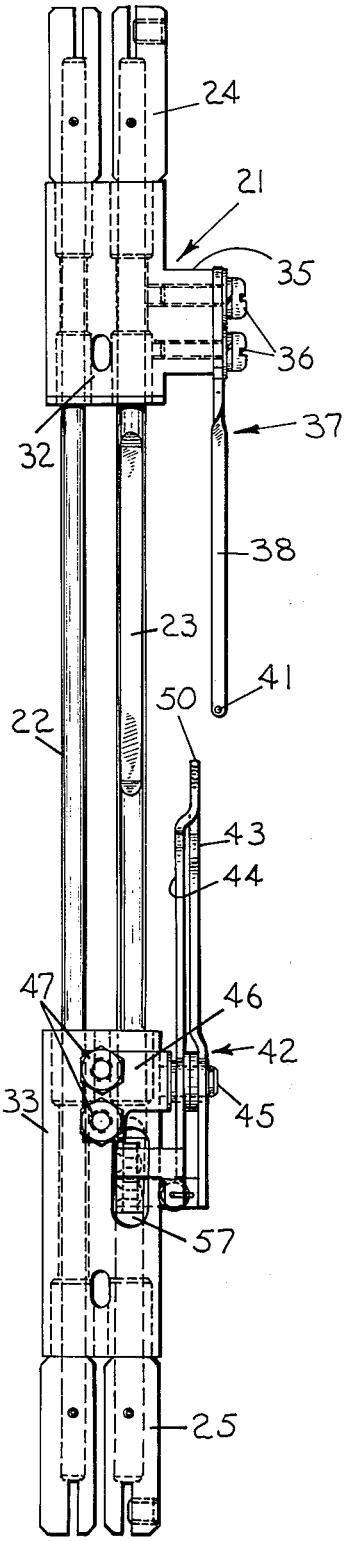
FIG. 3 is a view in side elevation of the selvage forming device showing the rod members with their means of attachment to adjacent harnesses and the support blocks with their selvage thread guides which are mounted for sliding movement on the rod members.
Figure 4:
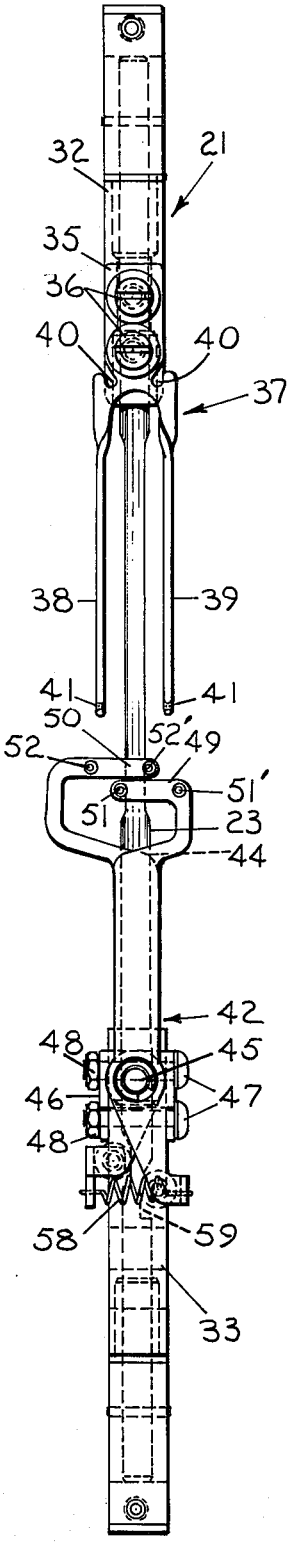
FIG. 4 is a view in front elevation of the device shown in FIG. 3.

The lower or second support block 33 has a second selvage thread guide means generally indicated by number 42 mounted for pivotal movement thereon. This selvage thread guide 42 includes a pair of double armed lever members 43 and 44 that are mounted intermediate their ends on a common stud 45 carried on a U-shaped bracket 46 that is fixed to the support block 33 by means of bolts 47 and nuts 48 (FIGS. 3 and 4).

The double armed levers 43 and 44 extend in a generally vertical direction and the upper arm of each terminates in the form of a laterally extending finger 49 and 50 respectively with each finger being provided with a pair of spaced eyelets through which the leno selvage threads Y-1, Y-3, Y-4 and Y-6 extend. The eyelets in finger 49 are depicted by numerals 51 and 51' and those in finger 50 by numerals 52 and 52'. The leno selvage threads Y-1 and Y-2 are threaded through eyelets 52 and 51 respectively and the leno selvage threads Y-4 and Y-6 are threaded through eyelets 52' and 51' respectively.

The means by which the double armed levers 43 and 44 are pivoted on stud 45 will now be described. The lower arms of the double armed levers 43 and 44 are identified by numerals 53 and 54 respectively (FIGS. 5 and 6) and each is provided adjacent its lower end with a roller member. The roller member carried by the lower arm 53 is depicted by numeral 55 and that by lower arm 54 by numeral 56. These roller members 55 and 56 are positioned by their respective lower arms in slots 57 (one only shown) provided in the lower or second support block 33 and are maintained in contact with the outer surface of rod member 23 by means of a coil spring 58 which interconnects the lower ends of said lower arms.

Figure 5:
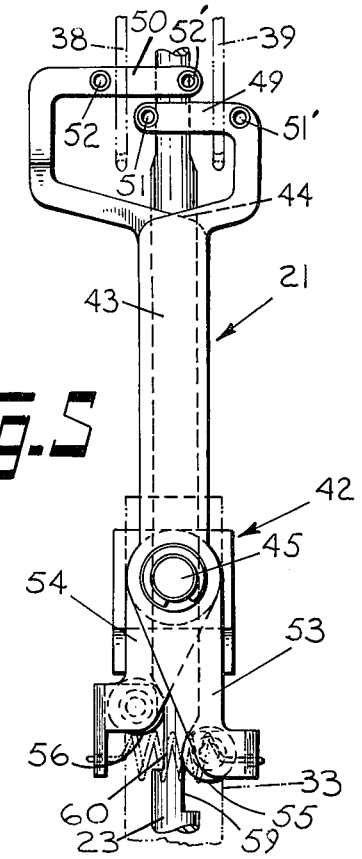
FIGS. 5 and 6 are views in front elevation and on an enlarged scale of the lower portion of FIG. 4 showing further detail of the camming means for pivoting the lower selvage thread guides between their inner and outermost positions.
Figure 6:
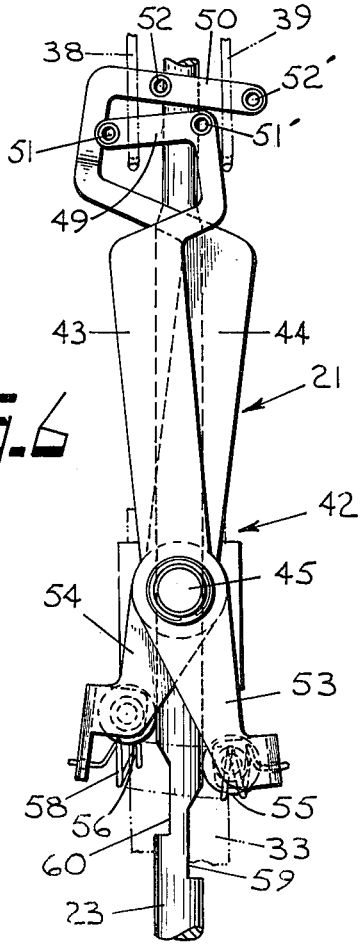

With reference to FIGS. 5 and 6 rod member 23 is shown provided with a pair of recesses 59 and 60 located in the pathway of the roller members 56 and 55 respectively. When the support block is caused to slide, in a manner to be described, on the rod members 22 and 23, the roller members will move into and out of the recesses 59 and 60 which serve as camming surfaces and are effective in pivoting the double armed levers between the two positions illustrated by FIGS. 5 and 6.

To summarize the operation the harness frames 14 and 31, during the shedding function move in opposite directions to raise or lower the sheet of warp threads each controls so as to form shed openings for the reception of weft yarn 20. When harness frame 14 moves downwardly and harness frame 31 moves upwardly the rod members 23 and 22 respectively carried thereby are caused to move in the same direction as shown in FIG. 9. This movement causes the support blocks 32 and 33 to slide towards each other and to move their respective selvage thread guides so as to form a shed opening with their selvage threads that align with the shed opening formed by the warp threads 12. During this movement roller members 55 and 56 are caused to move out of the recesses 59 and 60 in rod member 23 which effects pivotal movement of the double armed levers 43 and 44 and moves their laterally extending fingers 49 and 52 to that position shown in FIG. 6. To form the next shed opening the harness frames reverse their positions in a known manner which raises rod member 23 and lowers rod member 22 as shown in FIG. 10. This movement also slides the support blocks 32 and 33 towards each other from the crossing position of FIG. 8 and the upward movement of rod 23 causes roller members 55 and 56 to move into recesses 59 and 60. When the roller members enter these recesses the double armed levers are caused to pivot and their laterally extending fingers 49 and 50 move to the position shown in FIG. 5. This pivotal movement of the laterally extending fingers 49 and 50 between the position shown in FIGS. 5 and 6 causes the leno selvage threads supported in the eyelets thereof to alternately move in timed relation to shed openings formed thereby first on one side and then the other of the leno selvage threads Y-2 and Y-5. The combination of the leno selvage threads guided by the laterally extending fingers 49 and 50 as described relative to the Y-2 and Y-5 selvage threads forms a combination of loops which grip and hold each inserted pick of weft 20 as shown in FIG. 2.

By utilizing leno selvage threads in combination with the waste selvage threads 17 a substantially less number of the latter are required. Additionally it should be understood that instead of a double leno selvage as shown and described by the preferred embodiment a single leno selvage may be formed on the edge of the fabric by simply utilizing only those leno selvage yarns identified by Y-4, Y-5 and Y-6.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. Apparatus for forming a leno selvage along the edge of fabric being woven on a loom having harnesses extending widthwise of the loom that are vertically movable for crossing sheets of warp threads to form warp sheds for the reception of weft yarn, said apparatus comprising:

a. first and second elongated carrier members mountable on adjacent harness frames;

b. first and second means mounted for sliding movement on said first and second carrier members;

c. biasing means interconnecting said first and second sliding means and continuously urging said sliding means away from each other;

d. first selvage thread guide means mounted in a preselected position on one of said first and second sliding means;

e. second selvage thread guide means mounted on the other of said sliding means, said second thread guide means being mounted for pivotal movement between an innermost and an outermost position;

f. means operatively associated with said second selvage thread guide means to cause pivotal movement thereof between said innermost and outermost positions when the said one of said sliding means on which said second selvage guide means is mounted slides on said elongated carrier members which includes:

1. a roller member assembled to the lower arm of said double armed lever with said roller member being disposed in operative association with a cam surface integrally formed on one of said elongated carrier members.

* * * * *